US006951997B2

(12) United States Patent
Larson et al.

(10) Patent No.: US 6,951,997 B2
(45) Date of Patent: Oct. 4, 2005

(54) CONTROL OF A COOKTOP HEATING ELEMENT

(75) Inventors: Eric K. Larson, Cumberland, RI (US); Juan Barrena, Johnston, RI (US)

(73) Assignee: Ark-Les Corporation, Stoughton, MA (US)

( * ) Notice: Subject to any disclaimer, the term of this patent is extended or adjusted under 35 U.S.C. 154(b) by 0 days.

(21) Appl. No.: 10/206,885

(22) Filed: Jul. 26, 2002

(65) Prior Publication Data

US 2004/0016747 A1 Jan. 29, 2004

(51) Int. Cl.[7] ..... H05B 1/02
(52) U.S. Cl. ..... 219/492; 219/483
(58) Field of Search ..... 219/476, 477, 219/498, 482, 483, 490, 492, 579, 448.12, 462.1

(56) References Cited

U.S. PATENT DOCUMENTS

| | | | | |
|---|---|---|---|---|
| 3,169,176 A | | 2/1965 | Fisher | |
| 3,388,236 A | | 6/1968 | Holtkamp | |
| 3,474,227 A | | 10/1969 | Gambill | |
| 3,612,826 A | | 10/1971 | Deaton et al. | |
| 3,665,159 A | | 5/1972 | Becker et al. | |
| 3,699,307 A | | 10/1972 | Malkin | |
| 3,852,558 A | | 12/1974 | McCleerey et al. | |
| 4,017,702 A | * | 4/1977 | Harmon et al. | 219/715 |
| 4,052,591 A | | 10/1977 | Sekera et al. | |
| 4,088,984 A | | 5/1978 | Muramoto et al. | |
| 4,237,368 A | | 12/1980 | Welch | |
| 4,370,692 A | | 1/1983 | Wellman et al. | |
| 4,527,049 A | * | 7/1985 | Thomas et al. | 219/446.1 |
| 4,591,781 A | | 5/1986 | Larson | |
| 4,604,518 A | * | 8/1986 | Payne | 219/506 |
| 4,675,478 A | | 6/1987 | Song | |
| 4,896,004 A | | 1/1990 | Aframian | |
| 4,973,933 A | | 11/1990 | Kadlubowski | |
| 5,191,310 A | | 3/1993 | Obermann et al. | |
| 6,057,529 A | | 5/2000 | Kirby | |
| 6,111,231 A | | 8/2000 | Corson et al. | |
| 6,166,353 A | | 12/2000 | Senneville et al. | |

FOREIGN PATENT DOCUMENTS

| | | |
|---|---|---|
| EP | 0 372 462 | 5/1989 |
| JP | 55-65832 | 5/1980 |
| JP | 55-65833 | 5/1980 |
| JP | 55-65834 | 5/1980 |
| JP | 55-65835 | 5/1980 |
| JP | 59-56622 | 4/1984 |
| WO | WO91/13526 | 9/1991 |
| WO | WO98/24104 | 6/1998 |

OTHER PUBLICATIONS

Roland, E.T. & Patti, R.D. "Computer Aapplication in Appliance Testing, " IEEE Transactions on Industry Applications, vol. 1A–11, No. 5, pp. 560–3 Sept.–Oct. 1975.

Marx, E. "Infinitely Variable Control of Small Gas Burners" Warmed Gas Intl, vol. 33, No. 2–3, pp. 59–62, 1984.

Anonymous "Innovative Superheated Steam Production: new Superheated Model for Single and Double Flame and Smoke Tube Boilers" Brennstoff Waerme Kraft, vol. 40, No. 11/12, pp. 22–28, 1998.

Krischausky, L. "Development of an Extremely Nitro–oxide Poor Modulating Gas–burning Boiler" Zeitschrift fuer Heizung, Leuftung, Limatechnik, Haustechnik, vol. 46m No. 3, pp. 122–124, 1995.

(Continued)

*Primary Examiner*—Sang Y. Paik
(74) *Attorney, Agent, or Firm*—Fish & Richardson P.C.

(57) ABSTRACT

A user control generates a heat level input signal responsive to a user of a cooktop heating element. Logic generates an output signal having a duty cycle corresponding to the input signal. An electromechanical device connected to apply power from a source to the heating element in response to the output signal.

34 Claims, 7 Drawing Sheets

OTHER PUBLICATIONS

Kaphahn, W. Air Feed Systems in Stenter Dryers International Dryer, vol. 180, No. pp. 10–13, 1995.
Bagarry, J.N. "Three–channel Kiln Burner for Solid Fuels" World Chem, vol. 14, No. 1, pp. 36, 38, Jan. 1983.
"Foiling Machine" Boxboard Containers, p. 53, Dec. 1975.
Babyak, R.J. "Tabletop Cooking" Appliance Manufacturer, vol. 45, No. 2, pp. 65–67, Feb. 1997.
Anonymous, "More Halogen Power" Appliance Manufacturer, vol. 44, No. 2, pp. 89–90 Feb. 1986.
McKenzie, M.D. "Selling on Smooth Looks and Easy Care" Dealerscope Merchandising, vol. 37, No. 1, p. 126, Jan. 1995.
McKenzie, M.D. "Fit for a Chef" Dealerscope Merchandising, vol. 36, No. 11, pp. 68, Nov. 1994.
Anonymous "Major Appliance Merchandising" Dealerscope Merchandising, vol. 36, No. 10, pp. 60–62, Oct. 1994.
Meier K. "PTC Thermistor Heating Element" Appliance vol. 58, No. 11, p. 64(3), No. 2001.
"Control Products" Appliance, vol. 58, p. 116, Sep. 2001.
"Electric Charbroilers" Restaurants & Institutions, vol. 111, No. 18, p. 116, Aug. 2001.
"Build Your Business with Zoning"Contracting Business, vol. 57, No. 7, pp OHCA9, Jul. 2000.
"Frigidaire:Biggest Upscale Product Launch Due" HFD–The weekly Home Furnishings newspaper, p. 89, Feb. 1993.
"Heater Sales Cool Off" HFD–The Weekly Home Furnishings Newspaer, p. 64, Jan. 1993.
"GE Profile Series at Top of Line"HFD–The Weekly Home Furnishings Newspaper, p. 158, May 1992.
"Typhoons Yield a Better Malt Whiskey" Process Engineering, p. 23, May 1992.
"Kitchen Stovetop Equipment: What a Wide Range of Choices" Nationals Restaurant News, p. 50, Apr. 1992.
"Large–Surface Lab Hot Plates" Metallurgic, p. 167, Apr. 1992.
"More Cooktops Choices inJenn–Air Debuts" HFD–The Weekly Home Furnishings Newspaper, p. 100, Feb. 1992.
"Testing: Automatic Capillary Rheometer" Modern Plastics, p. 110, Aug. 1991.
Clark, B. Troubleshooting with a Multimeter The Family Handyman, vol. 50, No. 4, p. 23, Apr. 2000.
"2001 Trade Show in Print" Appliance, vol. 58, No. 5, May 2001.
"Utilities–Gas" Builder, vol. 24, No.1, p. 184, Jan. 2001.
"An Appliance Focus" Robert Shaw Appliance Controls: Appliance, vol. 50, No. 11, p. S28, Nov. 1993.
Henry, A. "Convenience that Cooks", Appliance, vol. 49, No. 5, p. 39(4), May. 1992.
Simpson, D. E. "Switching on in the 90's " Appliance, vol. 47, No. 3, p. 39(5), Mar. 1990.
Durocher, J. "Ranges and Cook tops" Restaurant Business, vol. 88, No. 3, p. 172(2), Feb. 10, 1989.
"Gaggenau USA Introduces New Dimension Cook top Line" HFD–The Weekly Home Furnishings Newspaper, vol. 62, No. 8, p. 86(2), Feb. 22, 1988.
Power, M. & Weber, C. "Full Circle" Builder (Natl Assoc of Home Builders) vol. 24, No. 1, Jan. 2001.
"Indoor Grills Handy, Capable Cookers" Consumer Reports, vol. 57, No. 2, pp. 90–93, Feb. 1993.
PIC12c509a "8–Bit Microcontroller" PIC12C5XX, Microchip Technology, 8–Pin, 8–Bit CMOS Microcontrollers 1999.
"Electric Charbroilers" Restaurant & Institutions, vol. 111, No. 25, p. 94, Oct. 15, 2001.
AN512 "Implementing Ohmmeter/Temperature Sensor" Microchip technology, 1997, 2002.

* cited by examiner

Profile A

402

| Switch position signal | Duty cycle |
|---|---|
| 0000 | 0% |
| 0001 | 1% |
| 0010 | 2% |
| 0011 | 3% |
| 0100 | 4% |
| 0101 | 5% |
| 0110 | 8% |
| 0111 | 10% |
| 1000 | 15% |
| 1001 | 20% |
| 1010 | 25% |
| 1011 | 30% |
| 1100 | 40% |
| 1101 | 50% |
| 1110 | 75% |
| 1111 | 100.0% |

FIG. 4a

Profile B

404

| Switch position signal | Duty cycle |
|---|---|
| 0000 | 0% |
| 0001 | 3.1% |
| 0010 | 4.5% |
| 0011 | 6.2% |
| 0100 | 7.9% |
| 0101 | 13.2% |
| 0110 | 21.8% |
| 0111 | 35.7% |
| 1000 | 43.5% |
| 1001 | 50.0% |
| 1010 | 55.8% |
| 1011 | 63.9% |
| 1100 | 78.7% |
| 1101 | 90.5% |
| 1110 | 96.2% |
| 1111 | 100.0% |

FIG. 4b

CONTROL OF A COOKTOP HEATING ELEMENT

BACKGROUND

The temperature of a cooktop heating element is typically controlled by a so-called infinite switch. The user sets a rotary knob on the switch to indicate how hot (in a range from low to high) he wants the heating element to run. The switch cycles power to the heating element at a frequency determined by the knob setting. The power is cycled on and off by the expansion and contraction of a bimetallic strip that causes the strip to make and break a contact through which power to the heating element is passed. The switched power also passes through the bimetallic causing it to get hot while the contact is made and to cool while the contact is broken. Rotating the knob changes the amount of deflection required for the bimetallic strip to trip the contact.

SUMMARY

In general, in one aspect, the invention features (a) a user control to generate a heat level input signal responsive to a user of a cooktop heating element, (b) logic to generate an output signal having a duty cycle corresponding to the input signal, and (c) an electromechanical device connected to apply power from a source to the heating element in response to the output signal.

Implementations of the invention may include one or more of the following features. The user control includes an absolute rotary encoder to generate the heat level input signal. The input signal includes a binary digital signal. The user control includes a multi-position switch connected to a series of resistors to provide discrete resistance steps relative to the angular position of the multi-position switch. The input signal includes an analog signal. The logic includes a logic device having no more than eight active pins. There is a a zero-crossing detection circuit to receive an AC power signal from a source and generate a signal indicative of the zero crossings of the AC power signal. The logic includes an input connected to receive the zero-crossing signal from the zero-crossing detection circuit, and in which the logic uses the zero-crossing signal in generating the output signal. The logic includes a data memory for storing data that associates input signal values with output signal values. The logic includes an input to receive a profile selection signal, and a data memory for profiles each defining an association between input signals and output signals, and in which the logic uses the profile selection signal to select one of the profiles. The electromechanical device includes a relay to apply power to the heating element in response to the output signal.

In general, in another aspect, the invention features such an apparatus for each of at least two cooktop heating elements of an electric range in which the logic (e.g., a single logic chip) generates an output signal from each of the heat level input signals.

Implementations of the invention may include one or more of the following features. Each user control includes a multi-position switch connected to a series of resistors to provide discrete resistance steps relative to the angular position of the multi-position switch. Each input signal includes an analog signal. The logic includes a logic device having no more than eight active pins. The logic includes a data memory for storing data that associates input signal values with output signal values. The logic includes an input to receive a profile selection signal, and a data memory for profiles each defining an association between input signals and output signals, and in which the logic uses the profile selection signal to select one of the profiles. Each electromechanical device includes separate relays to apply power to the respective heating elements in response to the output signals.

In general, in another aspect, the invention features (a) a user control which generates an input signal responsive to an input by a user of a cooktop heating element of an electric range, and (b) logic comprising a data memory for storing a plurality of manufacturer profiles, each manufacturer profile defining a relationship between input signals and output signals, (c) an input connected to receive the input signal, and (d) an input connected to receive a profile selection signal and use the profile selection signal to select one of the plurality of manufacturer profiles, and in which the logic uses the input signal and the selected profile to generate an output signal having a duty cycle corresponding to the input signal.

Implementations of the invention may include one or more of the following features. There is an electromechanical device connected to apply power from a source to the heating element in response to the output signal. The electromechanical device includes a transistor connected to receive power from the source, and a relay connected to apply power to the heating element in response to the output signal. The user control includes a multi-position switch connected to a series of resistors which provide discrete resistance steps relative to the angular position of the multi-position switch.

In general, in another aspect, the invention features an electric range comprising a housing, a plurality of cooktop heating elements mounted on a horizontal outer surface of the housing, a control system mounted on an outer surface of the housing, the control system comprising for each of the plurality of heating elements, a user control which generates an input signal responsive to an input by a user of a heating element, logic comprising a plurality of inputs, each input connected to receive an input signal from a user control, and in which the logic generates an output signal having a duty cycle corresponding to an input signal, and an electromechanical device connected to apply power from a source to a heating element in response to an output signal.

Implementations of the invention may include one or more of the following features. There is an indicator lamp mounted on an outer surface of the housing, which illuminates when power is applied to a heating element. The user control is positionable in an OFF position or one of a plurality of ON positions. An indicator lamp is mounted on an outer surface of the housing, which illuminates when the user control is positioned in an ON position. For each heating element, there may be an indicator lamp mounted on an outer surface of the housing which illuminates when power is applied to the heating element or there may be one indicator lamp for each set of two or more burners or one indicator lamp for the entire cooktop. Each user control is positionable in an OFF position or one of a plurality of ON positions, In general, in another aspect, the invention features a method that includes receiving a input signal from a user of a cooktop heating element of an electric range, generating an output signal having a duty cycle corresponding to the input signal, and applying power electromechanically from a source to the heating element in response to the output signal.

In general, in another aspect, the invention features a method that includes receiving an input signal responsive to an input by a user of a cooktop heating element, consulting a profile defining an association between the input signal and an output signal duty cycle, and generating an output signal having a duty cycle corresponding to the input signal.

Among the advantages of the invention are one or more of the following. The average energy output of the element can be set more finely and precisely and can be maintained at a more constant level, especially at low energy/power settings (i.e., simmer control) and temperatures, achieving true simmer control, which cannot be done effectively with current production electromechanical devices. Virtually any cycle rate imaginable may be achieved including rates that are below the 5% to 8% minimum that is typical of current devices. The commonly understood and consumer-preferred current user interface for electromechanical devices can be maintained. Thus, the electronics is "transparent" to the user. The cycle rate is maintained consistently over time and between units in a lot-to-lot production. The cost to achieve that advantage is relatively low. The electronics that control the cycling can be shared among more than one control knob, potentially reducing the cost. A low pin count inexpensive logic chip may be used. An inexpensive and reliable electromechanical component such as a relay can be used to deliver the power to the hearing element. Different duty cycle profiles for given knob settings can be implemented by simple programming to serve, for example, the needs of different manufacturers.

Other features and advantages of the invention will be apparent from the description and from the claims.

DESCRIPTION

FIG. 1 is a perspective view of an electric range.

FIG. 2*a* is a block diagram of a control system.

FIG. 2*b* is a perspective view of a housing.

FIG. 2*c* is a top view of a portion of a switch.

FIG. 2*d* is a perspective view of a switch body.

FIG. 2*e* is a perspective view of a shaft.

FIG. 3 is a circuit schematic.

FIGS. 4*a* and 4*b* are profile tables.

Figure 1:
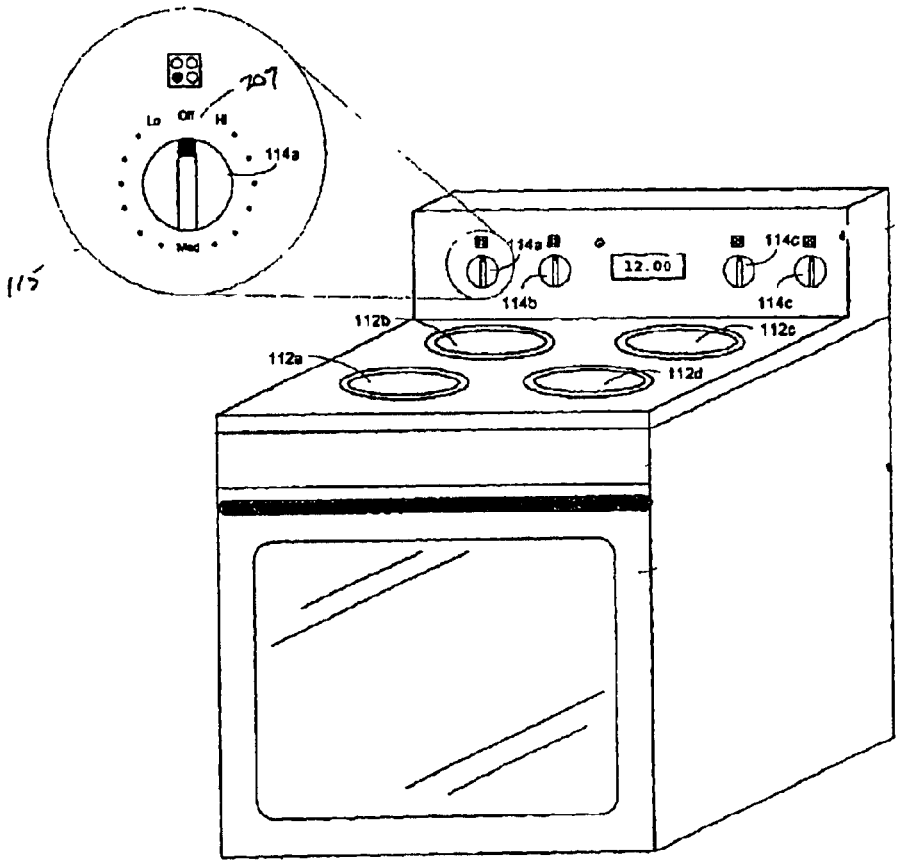

In FIG. 1, in an electric range 100, the temperature of each of four cooktop heating elements 112*a* through 112*d* is set by a user rotating a corresponding knob 114*a* through 114*d* to a position in a range 115 from low through medium to high. The position of the knob specifies whether the corresponding heating element is to be off or on and, if on, the desired level of heat to be delivered by the element. When the knob is set at the position 207, the corresponding heating element is off; in all other positions, the heating element is on.

Figure 2A:
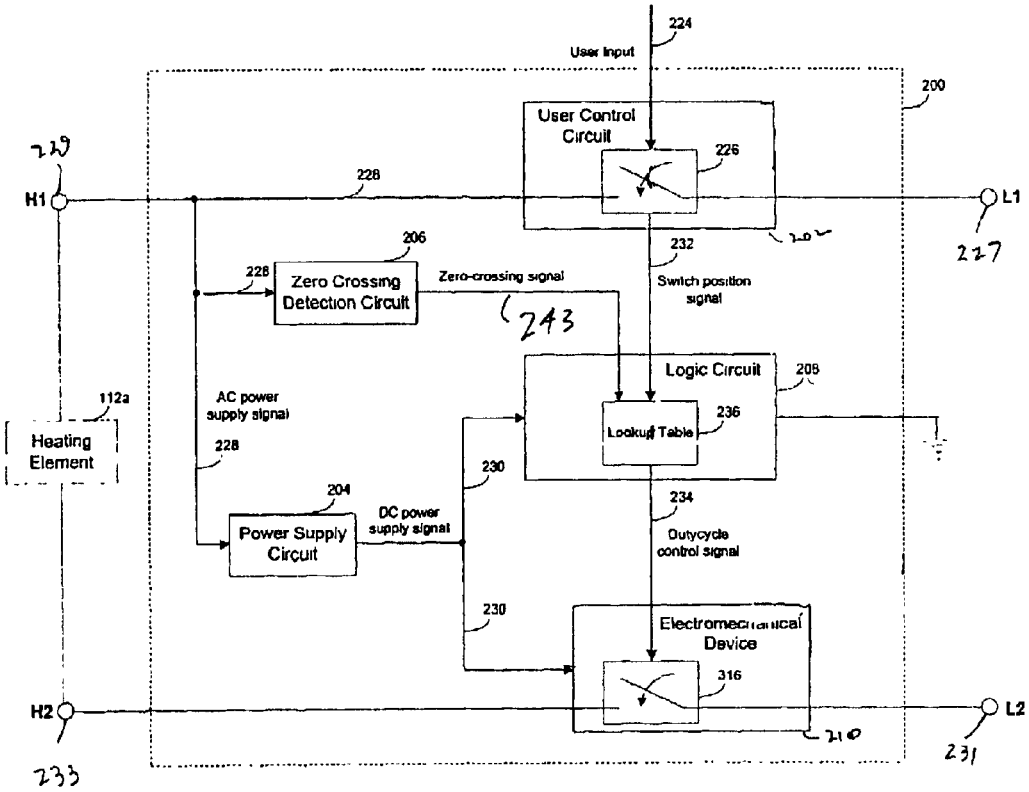

The knob is coupled by a shaft (in a manner described later) to a circuit 200 (FIG. 2*a*) that controls the on-off state of the heating element and the level of heat delivered by the element. Rotating the knob to any position other than the off position closes a switch 226 in the circuit 200, which couples one side 227 of the power source to one side 229 of the heating element 112*a*. The power circuit through the heating element is completed in a succession of power delivery cycles by a relay or other electromechanical switch 316 that couples a second side 231 of the power source to the second side 233 of the heating element. The duty cycle of the on-off switching of the electromechanical switching device 316 is determined by a duty cycle control signal 234 from a logic circuit 208.

The duty cycle control signal 234 specifies both the turn on and turn off moments in each duty cycle. The logic circuit bases the duty cycle control on a switch position signal 232, which indicates the rotational position of the knob (and hence the desired level of heating). To convert the switch position signal into a duty cycle value (the duty cycle is the portion of time when the switch is on), the logic circuit 208 uses a look-up table 236. Based on the duty cycle value the turn on and turn off moments can be determined and used to create the duty cycle control signal.

The lookup table 236 may be loaded (either at time of manufacture or, in some implementations, later) with any desired profile, such as a profile A 402 (FIG. 4*a*) or profile B 404 (FIG. 4*b*). Any profile could be used, for example, a profile specified by an electric range manufacturer for a particular electric range model. In some implementations, the profiles 402 and 404 could be modified to meet a user's expected cooking requirements. For example, profile B could be used to enable several low duty cycle rates (e.g., in the range 3% to 8%) for effective simmering of candy and chocolate sauces. Profile B provides a smaller spread of duty cycle rates over a wider range of switch positions as compared to profile A 402. The loading of different profiles could be done in response to preferences indicated by the user.

The precise turn on and turn off times of the duty cycle are selected so that they occur approximately when the AC power source is crossing through zero, to reduce stress on the electromechanical switch 210. For this purpose, a zero crossing detection circuit 206 determines the zero crossing times and indicates those times to the logic circuit using zero-crossing signal 243. The logic circuit 208 and the relay 316 are powered by DC power 230 generated from the AC power source using a power supply circuit 204.

Figure 2B:
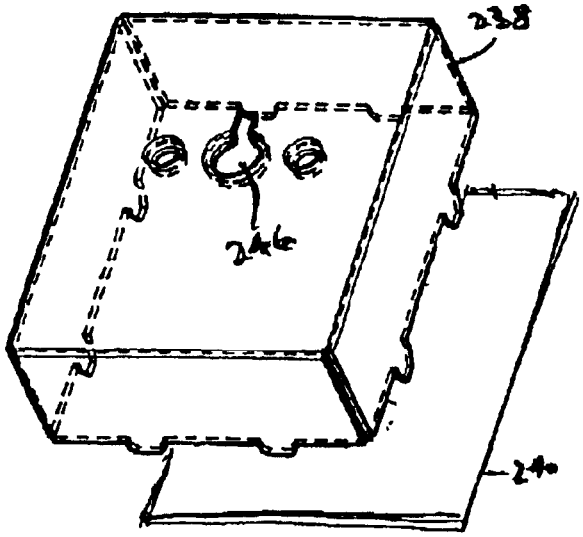
Figure 2C:
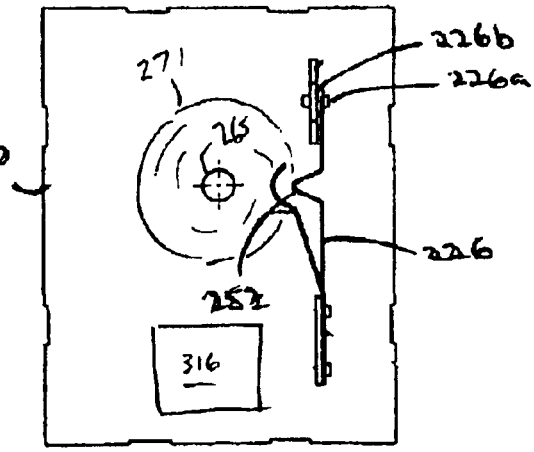
Figure 2D:
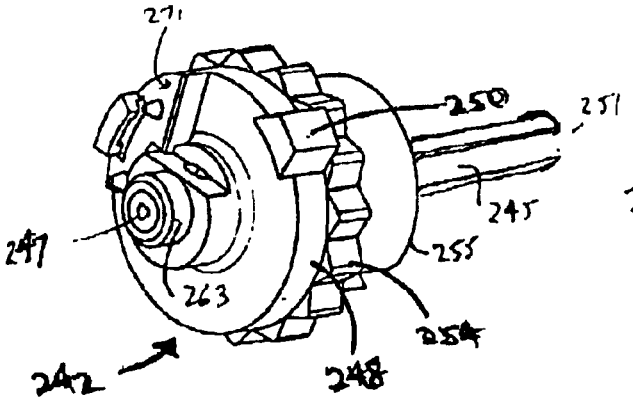
Figure 2E:
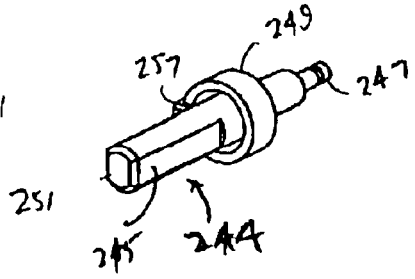

As shown in FIGS. 2B and 2C, the circuit 200 is formed on a circuit board 240 that is mounted in a housing 238 (and is shown unpopulated in FIG. 2B and partially unpopulated in FIG. 2C). The knob is mounted on an end 251 of a shaft 244 (FIG. 2E) and the other end 247 of the shaft rests within a bearing 263 (FIG. 2D) of a plastic rotator 242. A ring 249 that is part of the shaft seats within a housing 255 of the rotator and a key 257 on the ring mates with a channel so that rotation of the shaft drives the rotator. As assembled, the outer surface of bearing 263 rides within a hole 265 on the circuit board, and the shaft projects through a hole 246.

The rotator 242 has a geared surface 254 that cooperates with a resilient finger 252 to cause the knob to occupy discrete rotational positions. A key 250 on rotator 242 forces a resilient finger of switch 226 and the related contacts 226*a* and 226*b* open when the knob is in the off position; otherwise, switch 226 is closed.

For purposes of generating the switch position signal 232, the rotator may have metal wipers on a surface 271 that faces the surface of the board and the board may have ring-shaped metal wiping surfaces (shown schematically as 273) which together form an absolute rotary encoder that provides a unique 4-bit binary output for each of the 16 distinct positions of the knob 114*a*.

Figure 3:
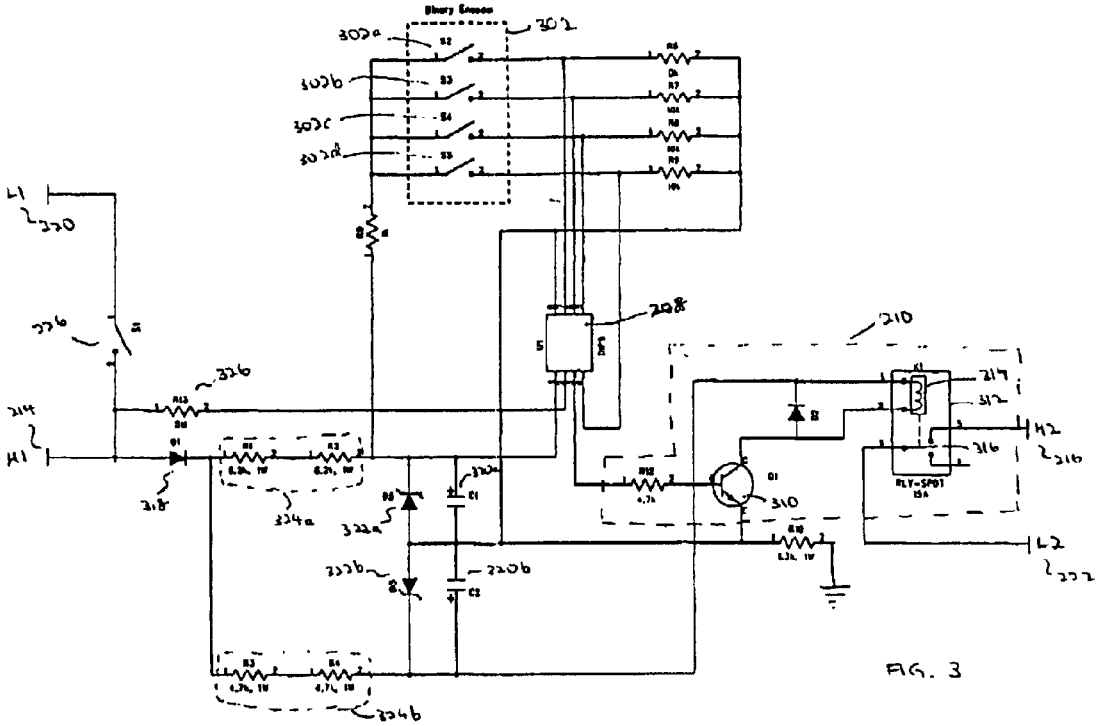

In the circuit shown in FIG. 3, the absolute rotary encoder is represented by switches S2 302*a*, S3 302*b*, S4 302*c*, and S5 302*d*. Say, for example, the user rotates the knob 114*a* to switch position "Lo". Switch S2 302*a* is closed and the absolute value encoder generates a switch position signal 232 of "0001". Similarly, when the user rotates the knob 114*a* to switch position "Hi", switches S2 302*a*, S3 302*b*, S4 302*c*, and S5 302*d* are closed and a switch position signal 232 of "1111" is generated. The switch position signal 232 can then be decoded by the logic circuit 208 to determine and act upon the position of the knob 114*a*.

The logic circuit 208 may be implemented using an 8-bit microcontroller 308, such as a PIC12C509A microcontroller from Microchip Technology Inc. In some implementations, the lookup table 236 is part of the microcontroller. Four of the eight pins of the microcontroller receive the encoded position signal from the encoder. Two pins of the microcontroller receive power and one pin (pin 3) provides the duty cycle signal to the electromechanical device 210. One pin can be used for either zero-crossing detection or user profile selection input.

Device 210 has an 80V NPN transistor 310 that drives a 15A relay 312, such as a KLTF1C15DC48 relay from Hasco Components International Corporation. The transistor 310 is turned on and off in accordance with the duty cycle control signal 234 generated at the microcontroller 308. When the duty cycle control signal 234 goes high, the transistor 310 turns on, allowing current to flow to the relay coil 314. This causes the relay 312 to switch its contacts 316, completing the power circuit to the heating element 112*a*.

When the electrical switch 226 is closed, AC power flows from the power line L1 to the power supply circuit 204. The AC power source 228 is half-wave rectified by diode 318, filtered by electrolytic capacitors 320*a* and 320*b*, and regulated by zener diodes 322*a* and 322*b* and resistors 324*a* and 324*b* to produce a DC power supply 230, which is used to power the logic circuit 208 and the electromechanical device 210.

In operation, then, the rotational position of the knob is encoded, and a logic circuit controls the duty cycle of the relay in accordance with the encoded position signal.

The zero-crossing detection circuit 206 is implemented as a high value resistor 326 (5MΩ) coupled between Line 1 and pin 2 of the microcontroller 308. The high resistance limits the current so that no damage occurs to the microcontroller 308. The microcontroller 308 includes software that polls pin 2 and reads a high state whenever the AC voltage waveform is near zero volts (i.e., AC voltage≈+2V relative to the circuit common). The transistor 310 is turned on and current is allowed to flow to the relay coil 314 only when the duty cycle control signal 234 is in a high state. The actual switching is performed only after pin 2 transitions from low to high when the duty cycle control signal is high. When the duty control signal goes low the switching is again performed only after pin 2 transitions from low to high. Arcing between the contacts 316 of the relay 312 is reduced when the relay 312 is switched at or near the zero crossing points of the AC voltage waveform. This has the effect of reducing contact erosion and prolonging the useful service life of the relay 312.

Although some implementations have been described above, other implementations are within the scope of the claims.

Figure 6:
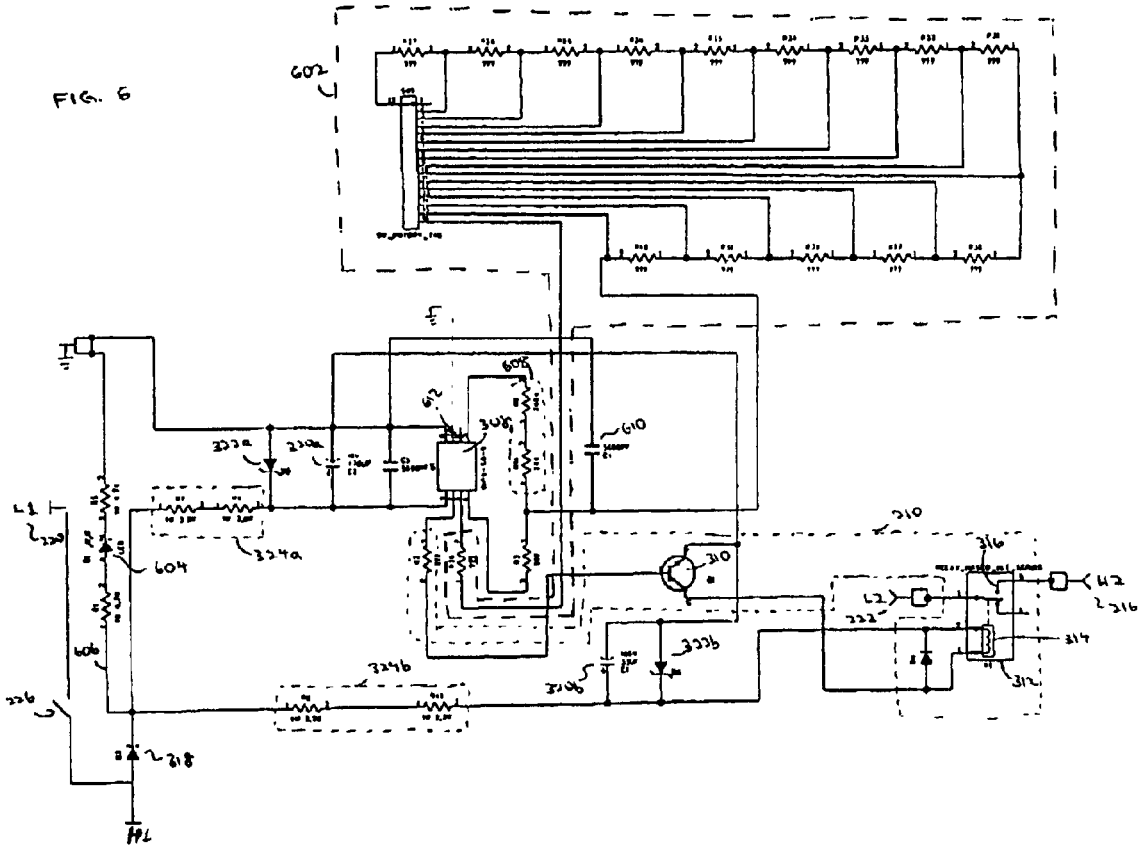
FIG. 6 is a circuit schematic.

The user control circuit 202 may use an analog encoder based on resistance in place of the binary encoding scheme to generate a switch position signal in response to a rotation of the knob 114*a*. The resistance value could be changed continuously using a single variable resistor, or discretely using multiple resistors connected in series as shown in box 602 of FIG. 6. In the analog implmenetations, the logic circuit 208 may use a capacitive charging circuit to convert a resistance-based switch position signal 232 to time, which can be easily measured using the microcontroller 308. A reference voltage is applied to a calibration resistor 608. The capacitor 610 charges up until the threshold on the chip input (pin 5 of the microcontroller 308) trips. This generates a software calibration value that is used to calibrate out most circuit errors, including inaccuracies in the capacitor 610, changes in the input threshold voltage and temperature variations. After the capacitor 610 is discharged, the reference voltage is applied to the resistance to be measured (i.e., the resistance across the rotary control 114*a*). The time to trip the threshold is then measured by the microcontroller 308 and compared to the calibration value to determine the actual resistance across the rotary control 114*a*. In some implementations, the switch position signal values in the lookup table 236 are time-based and reflect the time it takes for the resistance across the user control circuit 202 to trip the threshold on pin 5 of the microcontroller 308. A microprocessor with a built-in A to D converter could be used to read actual voltage levels from the resistors but that approach is more expensive.

Figure 5:
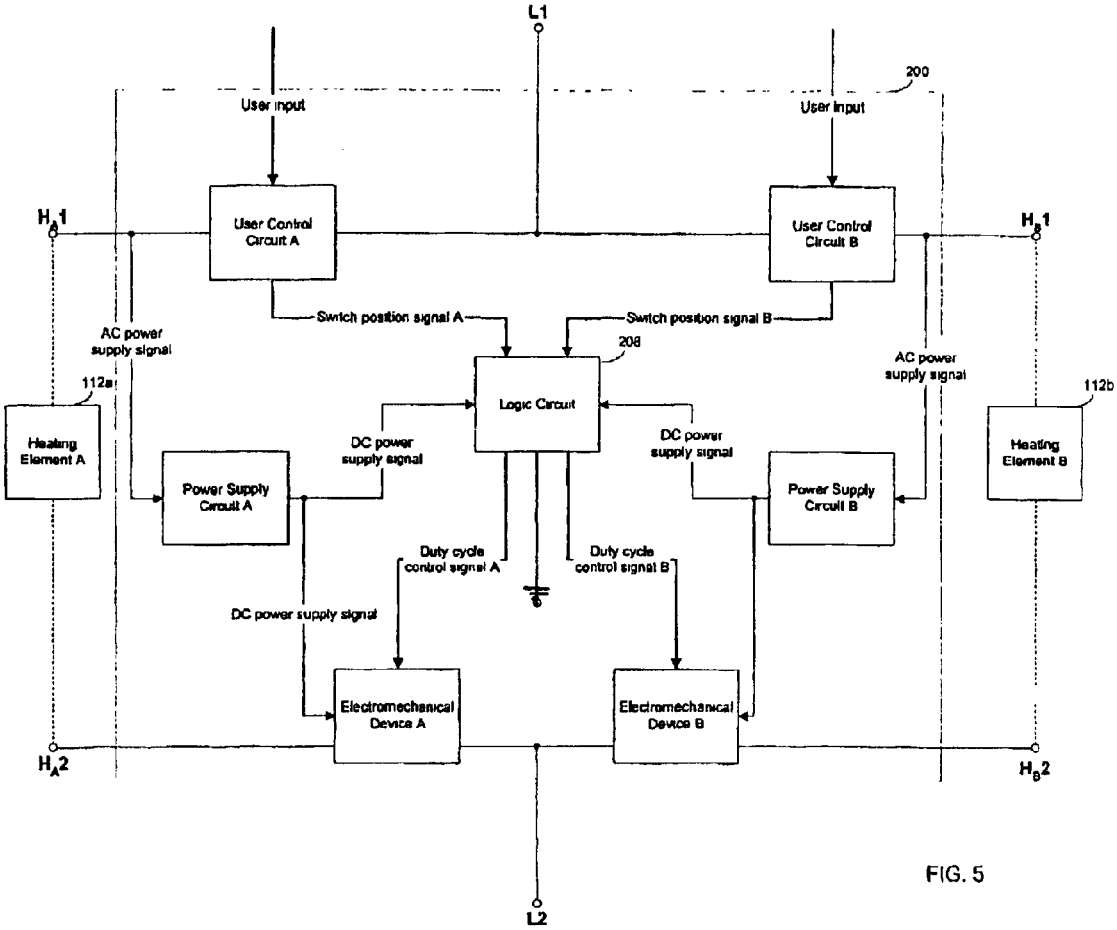
FIG. 5 is a block diagram of a control system.

The system 200 may be modified to control the rate at which power is delivered to two cooktop heating elements 112*a* and 112*b* of the electric range using a single logic circuit 208, as shown in FIG. 5.

In some implementations, a light-emitting diode 604 (FIG. 6) may receive power from a half-rectified line 606 and cause the hot cooktop indicator 118 (FIG. 1) to be lit when the electrical switch 226 is closed. Alternatively, a light-emitting diode may be connected such that the hot cooktop indicator 118 is illuminated when power is applied to a heating element (i.e., during the duty cycle).

Circuit 200 may be manufactured for use with two electric range models having different profiles. The models may be from the same electric range manufacturer or different electric range manufacturers. For this purpose, the microcontroller 308 may be pre-loaded with two profiles, such as profile A 402 (FIG. 4*a*) and profile B 404 (FIG. 4*b*). The microcontroller may also be loaded with software that polls a profile selection pin 612 (e.g., pin 7 of the microcontroller 308 shown in FIG. 6) and determines which of the two profiles should be used to interpret the switch position signals. Specifically, if the polling returns a high value, the microcontroller 308 interprets the switch position signals using profile A 402. Otherwise, the microcontroller 308 interprets the switch position signals using profile B 404. In some implementations, the circuit 200 may be manufactured with trace wiring connecting the profile selection pin 612 of the microcontroller 308 to supply voltage and supply ground. At the factory floor during assembly of the system 200, the appropriate trace wiring is punched out depending on which profile is to be used for that particular system 200. In another implementation, the system 200 is manufactured with a profile selection switch that a homeowner can flip between one of two positions to select which of the two pre-loaded profiles the microcontroller 308 should use in interpreting the switch position signals.

The cooktop heating element could be part of a hot plate or other device that is smaller or arranged differently than a conventional range top.

Other electromechanical devices that might be substituted for the relay include a solenoid or a contactor. A TRIAC might be used as a solid state switching solution in place of the relay.

What is claimed is:

1. An apparatus comprising:

a user control to generate a heat level input signal responsive to a user of a cooktop heating element;

logic to generate an output signal having a duty cycle corresponding to the input signal, the logic including:

an input to receive a profile selection signal; and a data memory for profiles each defining an association between input signals and output signals, and in which the logic uses the profile selection signal to select one of the profiles, the input signals being the same for each profile; and an electromechanical device connected to apply power from a source to the heating element in response to the output signal.

2. The apparatus of claim 1 wherein the user control comprises an absolute rotary encoder to generate the heat level input signal.

3. The apparatus of claim 1 wherein the input signal comprises a binary digital signal.

4. The apparatus of claim 1 wherein the user control comprises a multi position switch connected to a series of resistors to provide discrete resistance steps relative to the angular position of the multi position switch.

5. The apparatus of claim 1 wherein the input signal comprises an analog signal.

6. The apparatus of claim 1 wherein the logic comprises a logic device having no more than eight active pins.

7. The apparatus of claim 1, further comprising:

a zero crossing detection circuit to receive an AC power signal from a source and generate a signal indicative of the zero crossings of the AC power signal.

8. The apparatus of claim 7 wherein the logic further comprises:

an input connected to receive the zero-crossing signal from the zero crossing detection circuit; and in which the logic uses the zero crossing signal in generating the output signal.

9. The apparatus of claim 1 wherein the logic comprises:

a data memory for storing data that associates input signal values with output signal values.

10. The apparatus of claim 1 wherein the electromechanical device comprises:

a relay to apply power to the heating element in response to the output signal.

11. An apparatus comprising:

for each of at least two cooktop heating elements of an electric range, a user control to generate a heat level input signal responsive to a user of a cooktop heating element;

logic to generate an output signal from each of the heat level input signals, and logic including a data memory for storing a plurality of profiles each associating input signal values with output signal values, the input signals being the same for each profile, and separate electromechanical devices connected to apply power from a source each of the heating elements in response to a corresponding one of the output signal.

12. The apparatus of claim 11 wherein each user control comprises an absolute rotary encoder.

13. The apparatus of claim 11 wherein each user control comprises a multi-position switch connected to a series of resistors to provide discrete resistance steps relative to the angular position of the multi-position switch.

14. The apparatus of claim 11 wherein each input signal comprises an analog signal.

15. The apparatus of claim 11 wherein the logic comprises a logic device having no more than eight active pins.

16. The apparatus of claim 11, further comprising:

an input connected to receive the zero crossing signal from the zero crossing detection circuit; and in which the logic uses the zero crossing signal in generating the output signal.

17. The apparatus of claim 11 wherein the logic further comprises:

an input connected to receive the zero-crossing signal from the zero-crossing detection circuit; and in which the logic uses the zero-crossing signal.

18. The apparatus of claim 11 wherein the logic comprises:

a data memory for storing data that associates input signal values with output signal values.

19. The apparatus of claim 12 wherein each electromechanical device comprises:

separate relays to apply power to the respective heating elements in response to the output signals.

20. An apparatus comprising:

a user control which generates an input signal responsive to an input by a user of a cooktop heating element of an electric range; and logic comprising a data memory for storing a plurality of manufacturer profiles, each manufacturer profile defining a relationship between input signals and output signals, the input signals being the same for each profile;

an input connected to receive the input signal; and an input connected to receive a profile selection signal and use the profile selection signal to select one of the plurality of manufacturer profiles, and in which the logic uses the input signal and the selected profile to generate an output signal having a duty cycle corresponding to the input signal.

21. The apparatus of claim 20, further comprising an electromechanical device connected to apply power from a source to the heating element in response to the output signal.

22. The apparatus of claim 21, wherein the electromechanical device comprises:

a transistor connected to receive power from the source; and a relay connected to apply power to the heating element in response to the output signal.

23. The apparatus of claim 21 wherein the user control comprises an absolute rotary encoder.

24. The apparatus of claim 21 wherein the input signal comprises a binary digital signal.

25. The apparatus of claim 21 wherein the user control comprises a multi-position switch connected to a series of resistors which provide discrete resistance steps relative to the angular position of the multi-position switch.

26. The apparatus of claim 21 wherein the input signal comprises an analog signal.

27. The apparatus of claim 21 wherein the source is an AC power source.

28. The apparatus of claim 21, further comprising:

a zero-crossing detection circuit connected to receive an AC power signal from the source and generate a signal indicative of the zero crossings of the AC power signal.

29. The apparatus of claim 20 wherein the logic further comprises:

an input connected to receive the zero-crossing signal from the zero-crossing detection circuit; and in which the logic uses the zero-crossing signal.

30. An electric range comprising:

a housing;

a plurality of cooktop heating elements mounted on a horizontal outer surface of the housing;

a control system mounted on an outer surface of the housing, the control system comprising for each of the plurality of heating elements, a user control which generates an input signal responsive to an input by a user of a heating element;

logic comprising a plurality of inputs, each input connected to receive an input signal from a user control, and in which the logic generates an output signal having a duty cycle corresponding to an input signal, the logic including a data memory for storing a plurality of profiles each associating input signal values with output signal values, the input signals being the same for each profile; and an electromechanical device connected to apply power from a source to a heating element in response to an output signal.

31. The apparatus of claim 30, further comprising:

an indicator lamp mounted on an outer surface of the housing which illuminates when power is applied to a heating element.

32. The apparatus of claim 31, wherein the user control is positionable in an OFF position or one of a plurality of ON positions, the apparatus further comprising:

an indicator lamp mounted on an outer surface of the housing which illuminates when the user control is positioned in an ON position.

33. The apparatus of claim 31, further comprising:

for each heating element, an indicator lamp mounted on an outer surface of the housing which illuminates when power is applied to the heating element.

34. The apparatus of claim 31, wherein each user control is positionable in an OFF position or one of a plurality of ON positions, the apparatus further comprising:

for each heating element, an indicator lamp mounted on an outer surface of the housing which illuminates when the user control is positioned in an ON position.

* * * * *